US007510381B2

(12) United States Patent
Beckmann et al.

(10) Patent No.: US 7,510,381 B2
(45) Date of Patent: Mar. 31, 2009

(54) LUBRICATING SYSTEM FOR A ROTARY COMPRESSOR

(75) Inventors: Frank Beckmann, Aerzen (DE); Hans-Ulrich Fleige, Hameln (DE); Ulrich Götzel, Detmold (DE); Björn Irtel, Hameln (DE); Oliver Palm, Lauenau (DE)

(73) Assignee: Aerzener Mashinenfabrik GBBH, Aerzen (DE)

( * ) Notice: Subject to any disclaimer, the term of this patent is extended or adjusted under 35 U.S.C. 154(b) by 0 days.

(21) Appl. No.: 11/746,938

(22) Filed: May 10, 2007

(65) Prior Publication Data

US 2007/0274851 A1 Nov. 29, 2007

(30) Foreign Application Priority Data

May 11, 2006 (EP) ..... 06009779

(51) Int. Cl.
*F01C 21/04* (2006.01)
*F03C 2/00* (2006.01)

(52) U.S. Cl. ..... 418/83; 418/96; 418/98; 418/206.1; 418/206.8; 184/11.1; 184/13.1

(58) Field of Classification Search ..... 418/83, 418/96, 97, 98, 201.1, 206.1, 206.3, 206.7, 418/206.8, 270, DIG. 1; 417/310; 184/6.16, 184/6.17, 11.1, 13.1
See application file for complete search history.

(56) References Cited

U.S. PATENT DOCUMENTS

| | | | | |
|---|---|---|---|---|
| 1,066,815 | A * | 7/1913 | Herring | 418/96 |
| 1,582,961 | A * | 5/1926 | Berrenberg | 418/96 |
| 2,361,146 | A * | 10/1944 | Montelius | 418/96 |
| 3,912,044 | A * | 10/1975 | Schindelhauer | 184/6.16 |
| 4,632,650 | A * | 12/1986 | Frieden et al. | 418/96 |
| 4,993,930 | A * | 2/1991 | Uchida et al. | 418/DIG. 1 |
| 5,044,895 | A | 9/1991 | Frieden et al. | |
| 2003/0035738 | A1 | 2/2003 | Kim | |
| 2004/0219045 | A1 | 11/2004 | Yoshimura et al. | |

FOREIGN PATENT DOCUMENTS

| | | |
|---|---|---|
| DE | 8405144.2 | 6/1987 |
| DE | 8714166.3 | 2/1988 |
| DE | 10197228 | 4/2004 |
| EP | 0188713 A2 | 7/1986 |

OTHER PUBLICATIONS

Machine translation of DE 8714166.3, taken from ep.espacenet.com.
Machine translation of EP 0188713, taken from ep.espacenet.com.
Machine Translation of DE 84 05 144 U, taken from worldlingo.com.

* cited by examiner

*Primary Examiner*—Theresa Trieu
(74) *Attorney, Agent, or Firm*—Wolf, Greenfield & Sacks, P.C.

(57) ABSTRACT

The invention provides a twin-shaft, dry-running rotary piston machine (1) comprising two rotary pistons (8) supported in a housing (2) via shafts (4) and roller bearings (6) with rolling elements, said rotary pistons are horizontally arranged and mesh with each other in opposite directions, so as to define a conveying chamber; two oil chambers (10) arranged in said housing (2) at opposite front sides of the conveying chamber in the area of the roller bearings (6) and provided to be at least in part filled with lubricating oil, two splash elements (12), with per oil chamber (10) one splash element (12) being arranged on the shafts (4) in such a manner that every shaft (4) carries a total of only one splash element (12); and at least two connection channels (14) connecting the two oil chambers (10) with each other. The rotary piston machine according to the invention is also characterized in that the terminal cross sections (14') of said at least two connection channels (14) are arranged at the oil chambers (10) at least in part below the axial lines (4') of the shafts (4).

11 Claims, 1 Drawing Sheet

LUBRICATING SYSTEM FOR A ROTARY COMPRESSOR

CROSS REFERENCE TO RELATED APPLICATION

Foreign priority benefits are claimed under 35 U.S.C. §119 (a-d) or 35 U.S.C. §365(b) of European application no. EP 0609779.7, filed May 11, 2006, which is hereby incorporated by reference in its entirety.

TECHNICAL FIELD

The invention relates to a twin-shaft, dry-running rotary piston machine comprising two rotary pistons supported in a housing via shafts and roller bearings with rolling elements, said rotary pistons are horizontally arranged and mesh with each other in opposite directions, so as to define a conveying chamber, according to the preamble of claim 1.

PRIOR ART

Twin-shaft rotary piston machines have two intermeshing rotary pistons or rotors which are rotated in opposite directions in a working chamber which is formed by cylindrical housing bores for the rotors penetrating each other in an axially parallel manner and which is limited at the front side by terminating walls. This creates a conveying effect. Each rotor is attached to a pertinent shaft which is rotatably supported in the housing by roller bearings. Generally, one of the shafts is driven externally while the other shaft is rotated synchronously with the driving shaft by means of two intermeshing gear wheels attached on the shafts.

The arrangement of the two shafts can be carried out—with regard to the operating position—one on top of the other, hence in a vertical plane, or also adjacent to each other, hence in a horizontal plane. The present invention, however, only relates to twin-shaft rotary piston machines with an arrangement of the two shafts in a horizontal plane.

Since two shaft ends together with the pertinent bearings are respectively located at the two front-side (axial) ends of the working chamber, usually two separate oil chambers are formed. The drive-side oil chamber is thereby characterized by the additional shaft passage to the surroundings. In most cases, there are higher oil temperatures in the oil chamber where also the synchronizing wheels are located.

Lubricating oil or similar lubricants are used in order to reduce the frictional losses and mechanical wear of machine parts. There are essentially two basic methods, by means of which the lubricating oil is supplied to the points of consumption, i.e.:

a) splash lubrication b) (forced) feed lubrication by a pressurized system

Depending on the speed (performance, rotational speed) of a machine, the lubricating oil is distributed according to a) or b). Splash lubrication is conventionally used up to an average bearing speed of n*dm=0.5*10E6 mm/min (with: n=rotational speed [rpm] and dm=average diameter of the bearing [mm]). The lubricating oil is distributed to the points of consumption by means of the moving machine parts themselves or by means of specific additional devices (slingers, splash discs). Such splash lubrication by immersion using splash discs as well as oil-guiding plates is disclosed, for example, in DE 8405144 U1.

The fill level of the lubricant in the oil sump needs to be kept low in order to avoid unnecessary viscous losses and to moreover facilitate undisturbed return flow of the oil from the bearings. Viscous losses are understood to be the power (energy rate) required to move the rotating parts which immerse into the oil sump. They cause additional power consumption by the machine as well as undesired additional heating of the oil. On the other hand, an insufficient fill level of the lubricant in the oil sump, causes too little lubrication of the points which are to be supplied with lubricant. Cooling of the oil is effected by means of heat exchange with the large, wetted inner housing surfaces.

In the case of higher bearing circumferential speeds, this method of lubricating oil supply is no longer suitable, in particular due to insufficient cooling of the bearings. Mechanical dissipation loss increases with the speed to the power of two, i.e. a doubling of the rotation speed results in quadruplicating of the friction. The lubricating oil is then additionally required for heat transfer. Conventionally, an oil pump comprising a separate cooler is used in these cases. The oil pump supplies the lubricating oil through pipes and the cooler to the oil-injection nozzles which supply a defined oil stream to the lubrication points (bearings, gear wheels). Such forced feed lubrications allow to cover cases of application of n*dm=0.5 to 4*10E6 mm/min (cf. Beitz, W.; Grote, K.-H.: *Dubbel—Taschenbuch fuer den Maschinenbau* [Pocket Book on Mechanical Engineering], 19$^{th}$ edition, Springer-Verlag 1997, p. G174, Annex G4, Table 3).

Forced feed lubrications are very complex and expensive since they require a plurality of components such as an oil pump, piping, cooler, injection nozzles and further mounted parts. Thus, attempts have been known to realize at least in part forced feed lubrications without separate pumps. For example in DE 87 14 166 U1, it is suggested to use the synchronization gear wheels which are inevitably provided in many rotary piston machines at the same time also as a gear wheel pump.

Another approach is to use a pitot tube laterally and approximately tangentially arranged on a splash disc, to build up a certain oil pressure which may then be used for specifically supplying individual bearing points. Such a solution is disclosed, for example, in EP 188 713 B1. Both approaches do not, however, solve the problem of cooling the oil. Even if sufficient pressure build-up occurs in order to be able to implement forced feed lubrication with an oil cooler, the oil cooler alone results in a very complex and expensive construction.

Furthermore, DE 101 97 228 T5 refers in its introduction to a rotary piston machine according to the preamble of claim 1. The splash lubrication disclosed therein, however, also facilitates, due to the limited cooling and lubrication efficiency, only comparably small bearing speeds and hence rotational speeds.

SUMMARY OF THE INVENTION

It is the object of the present invention to provide a rotary piston machine of the type mentioned in the beginning which facilitates high rotation speeds and, at the same time, is of a simple construction.

This object is solved according to the invention by means of a rotary piston machine having the features of claim 1. Particularly advantageous developments of the invention are given in the dependent claims.

The invention is based on the idea of improving the cooling and lubricating efficiency of the lubricating oil by implementing cooling by means of oil circulation between the two oil chambers without using a separate oil pump and a separate oil cooler.

According to the invention, it is provided for this purpose that the at least two connection channels are arranged and designed in such a manner that they facilitate such an oil circulation without further components. More precisely, it is provided, according to the invention, that the terminal cross-sections of said at least two connection channels are arranged at the oil chambers at least in part below the axial lines of the shafts. This results, in combination with the "diagonally" arranged splash elements in that the oil flow generated by means of said splash elements can flow from one oil chamber into the other and back.

Thereby, one obtains—despite a simple construction of the rotary piston machine—an efficient circulation and cooling of the lubricating oil and thus efficient lubrication and cooling of the roller bearings. This leads to the result that it is possible using the rotary piston machine according to the invention to attain high bearing circumferential speeds or rotational speeds.

Further embodiments and advantages of the present invention will become apparent in more detail from the following description.

DETAILED DESCRIPTION OF PREFERRED EMBODIMENTS

Preferred embodiments of the present invention will be described in detail below making reference to the accompanying drawings.

Figure 1:
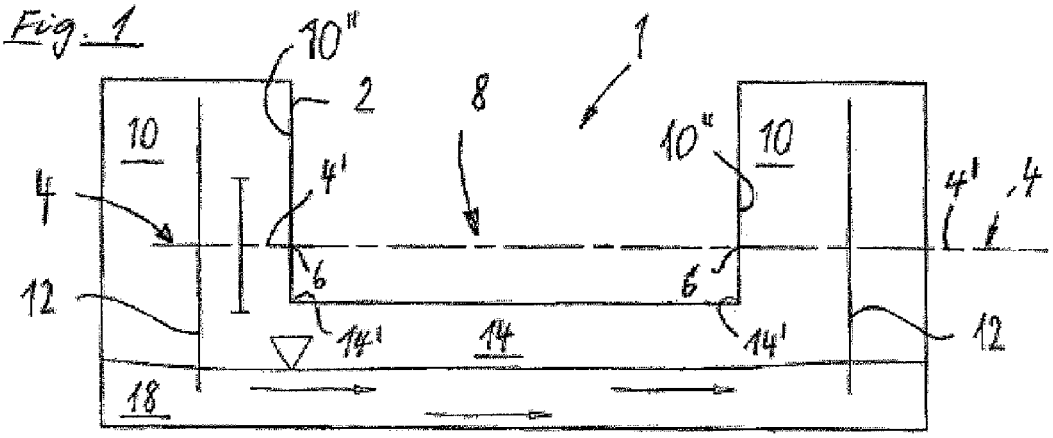
FIG. 1 schematically shows a sectional side view of a rotary piston machine according to a preferred embodiment of the present invention.
Figure 2:
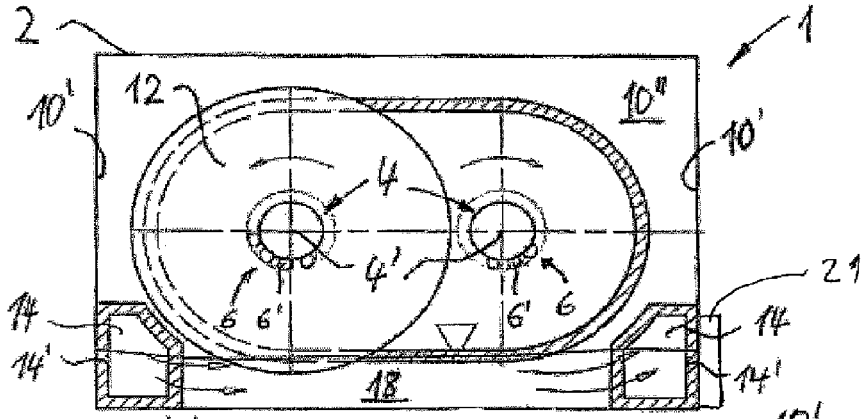
FIG. 2 schematically shows a sectional front view of the rotary piston machine shown in FIG. 1.
Figure 3:
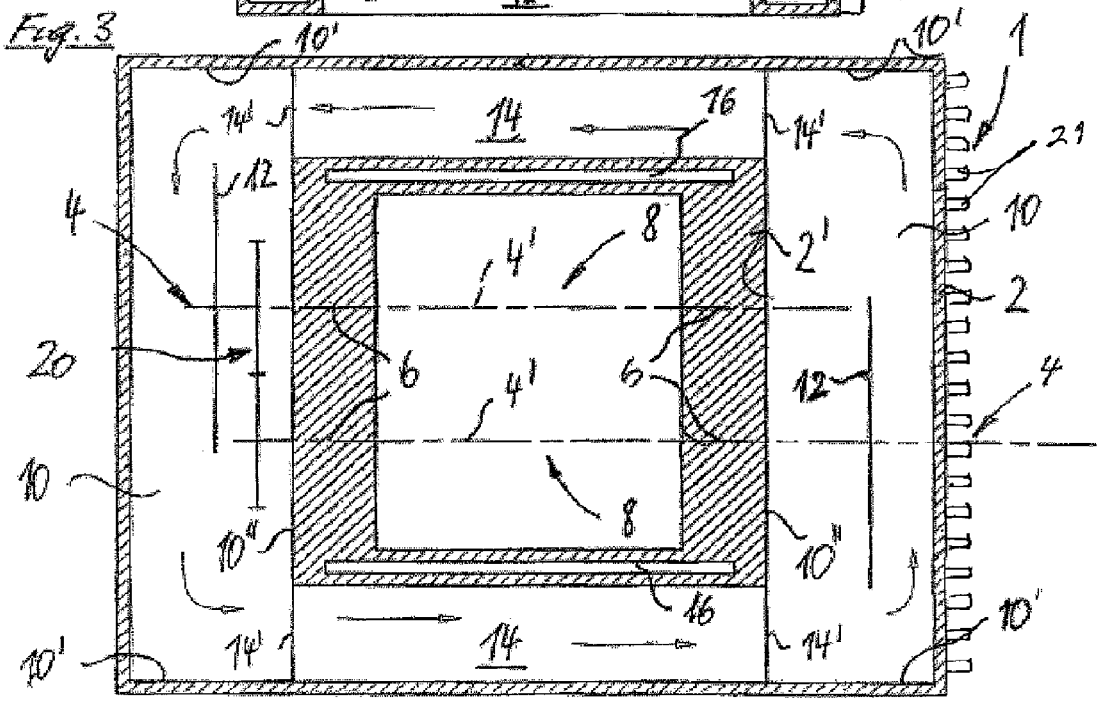
FIG. 3 schematically shows a sectional top view of the rotary piston machine shown in FIG. 1.

FIGS. 1 to 3 schematically show different views of a rotary piston machine 1 as an exemplary embodiment of the present invention. Rotary piston machine 1 includes two rotary pistons or rotors 8, not shown in more detail in the figures, which are supported in a housing 2 and rotated in opposite directions in order to create a conveying effect. Each rotor 8 is attached to a pertinent shaft 4 which is rotatably supported in housing 2 using roller bearings 6 with rolling elements 6' (of which only some are schematically shown). In general, one of the shafts is driven externally in a manner not shown in any more detail herein while the other shaft is rotated synchronously with the drive shaft by means of two intermeshing gear wheels 20 attached on the shafts. The arrows in FIG. 2 characterize the rotational directions of rotary pistons 8. The conveying direction of rotary piston machine 1 which was selected as an exemplary embodiment is thus from the top towards the bottom.

Furthermore, rotary piston machine 1 comprises two oil chambers 10 arranged in housing 2 at opposite face sides of the conveying chamber in the area of roller bearings 6 and intended to be filled at least in part with lubricating oil. The drive-side oil chamber is thereby characterized by the additional shaft passage to the surrounding area. In the opposite oil chamber the synchronizing wheels 20 are located.

The shown rotary piston machine is a dry-running rotary piston machine, i.e. a rotary piston machine in which no lubrication of the rotary pistons is carried out, but the rotary pistons run without contact. Correspondingly, oil chambers 10 are sealed from the conveying chamber defined by the rotary pistons.

In oil chambers 10 there two splash elements or splash discs 12 are provided, whereas per oil chamber 10 one splash element 12 is arranged on shafts 4 in such a manner that every shaft 4 supports a total of only one splash element 12. Splash elements or splash discs 12 are thus "diagonally" arranged. In oil chambers 10 the lubricant (oil) is carried along by splash discs 12 which immerse into the oil sump by means of dragging effects and are distributed in the oil chamber as droplets and mist. The dragging effect can be intensified by slots on the circumference of the splash discs or by similar measures caused by he dragging effect of splash discs 12, the oil is transported in the respective oil chamber 10 to that side of the shaft where there is no splash disc. In the prior art the oil level is thereby deformed, an "oil hill (bump)" is formed, whereby the effective immersion depth of the disc is reduced and the discharge of oil from the bearing of the adjacent shaft is obstructed. The same process arises in the opposite oil chamber. If the splash discs are now diagonally arranged (FIG. 3), the oil hill (bump) and the oil trough of the two oil chambers 10 are opposite each other.

The two oil chambers 10 are connected with each other by means of two oil channels 14. As can best be seen in FIG. 1, terminal cross-sections 14' of connection channels 14 are arranged at the oil chambers below the axial lines 4' of shafts 4. Although roller elements 6' of roller bearings 6 are only schematically and partially shown, terminal cross-sections 14' of connection channels 14 are also arranged below the roller elements 6'. Terminal cross-sections 14' of connection channels 14 are thereby located, in part or optionally also entirely, below the free (oil) level of lubricant 18 in oil chambers 10. In this regard, it is possible that terminal cross-sections 14' of only one or both connection channels 14 are arranged entirely below the free oil level, whereas in the latter case an additional pressure-balancing pipe may be provided. Furthermore, in the present embodiment, connection channels 14 or, more precisely, their terminal cross-sections 14' are located in the area of the opposite side walls 10' of oil chambers 10.

The oil in the relevant oil sump 10 is driven by the corresponding splash disc 12 and flows in the direction of connection channel 14 which is located downstream (the direction of flow is schematically indicated in the figures by means of arrows). Connection channel 14 guides the oil to the opposite oil chamber 10. Splash disc 12 in opposite oil chamber 10 drives the oil further outside in the direction of the second oil channel 14 which is located outside. Said oil channel then guides the oil back to the first oil chamber 10.

Thus, there is an exchange of oil and thus a balancing of the oil temperature between the two oil chambers. This results in the housing parts being tempered more equally which allows for less play between the rotors and the housing and thus facilitates an increase of efficiency.

The increased surface of the two connection channels 14, the larger oil volume and the improved heat transmission due to the speed of the circular flow facilitates releasing more heat. This enables operation without an expensive external oil cooler. In addition, the surface of the oil connections may be equipped with cooling fins 21.

Due to the discharge capability of the respective connection channels 14 no "oil hill" can form below a shaft bearing 6, whereby the drainage of the oil from the bearing and thus cooling of the bearing is improved.

Another advantage of the invention lies in the improved ease of maintenance since, due to the connected oil chambers, only one filling and discharge possibility needs to be provided.

Taken from a constructive point of view, there is provided in the present embodiment that connection channels 14 are molded in one part with a housing cylinder 2' which surrounds the rotary pistons 8. In this regard, an air layer 16 is provided between connection channels 14 and housing cylinder 2' as can best be seen in FIG. 3. This ensures that the heat of compression created in the area of rotary pistons 8 does not lead to an undesired heating of the oil circulating in connection channels 14.

The design of the cross-section of connection channels 14 is not specifically restricted within the framework of the present invention. It has, however, proven to be advantageous if connection channels 14 have a large cross-section, for example a cross-section which, in proportion to the rotary piston-side front surface 10" of the oil chamber which is wetted with oil (exposed to contact with oil) upon a standstill of the machine, amounts to at least 5%, preferably at least 10% and particularly preferable not more than 25%. This results in a particularly efficient circulation of the oil with small "oil hills and troughs". It is particularly preferred in this regard that connection channels 14 each have essentially the same cross-section and that the same is also constant over the length of the respective connection channel.

The invention claimed is:

1. A twin-shaft, dry-running rotary piston machine comprising a housing;

a pair of rotary pistons, each supported in the housing via a corresponding horizontal shaft and roller bearings with rolling elements located at each end of the corresponding shaft, each of said pair of rotary pistons configured to rotate about a horizontal axis that lies centrally along the corresponding horizontal shaft, the pair of rotary pistons constructed and arranged to mesh with each other in opposite directions, so as to define a conveying chamber, a pair of oil chambers located in said housing, positioned at opposite sides of said conveying chamber in an area of the roller bearings and provided to be at least in part filled with lubricating oil, two splash elements, with one splash element per oil chamber arranged on the shafts such that each shaft carries one splash element, and at least two connection channels that fluidly connect the pair of oil chambers with each other and that convey lubricating oil having a free oil level in the connection channels that lies below the horizontal axis of each of the pair of rotary pistons.

2. The rotary piston machine according to claim 1, wherein the free oil level of the lubricating oil conveyed in said at least two connection channels is below the rolling elements of the roller bearings.

3. The rotary piston machine according to claim 1, wherein the free oil level of the lubricating oil conveyed in said at least two connection channels is below a free oil level of lubricating oil in said oil chambers.

4. The rotary piston machine according to claim 1, wherein said at least two connection channels are fluidly connected to the oil chambers, when taken from a top view, at least in part outside a projection of the axial lines of the shafts.

5. The rotary piston machine according to claim 4, wherein said at least two connection channels are arranged in an area of opposite side walls of the individual oil chambers.

6. The rotary piston machine, according to claim 1, wherein the connection channels are equipped with cooling elements.

7. The rotary piston machine according claim 1, wherein the connection channels are molded in one part with at least one section of the housing surrounding the rotary pistons.

8. The rotary piston machine according to claim 7, wherein between the connection channels and the housing cylinder there is at least in part an insulating layer.

9. The rotary piston machine according to claim 1, wherein the connection channels have a cross-section which, in proportion to a rotary piston-side front surface of the oil chamber which, upon a standstill of the machine, is wetted with oil, at least 5%.

10. The rotary piston machine according to claim 1, wherein the connection channels each have a similar cross-section and said cross-section is substantially constant over the length of the respective connection channel.

11. The rotary piston machine according to claim 1, including the lubricating oil,

* * * * *